US009187813B2

(12) United States Patent
Yamauchi et al.

(10) Patent No.: US 9,187,813 B2
(45) Date of Patent: Nov. 17, 2015

(54) METHOD AND DEVICE FOR REMOVING METAL FUMES INSIDE SNOUT IN CONTINUOUS HOT-DIP PLATING PLANT

(75) Inventors: Yu Yamauchi, Tokyo (JP); Mikio Kawamura, Tokyo (JP); Kuniaki Yamamoto, Tokyo (JP); Tokuhiro Mizuno, Tokyo (JP); Noboru Furuta, Tokyo (JP)

(73) Assignee: NIPPON STEEL AND SUMITOMO METAL CORPORATION, Tokyo (JP)

( * ) Notice: Subject to any disclaimer, the term of this patent is extended or adjusted under 35 U.S.C. 154(b) by 0 days.

(21) Appl. No.: 13/820,915

(22) PCT Filed: Jul. 3, 2012

(86) PCT No.: PCT/JP2012/066947

§ 371 (c)(1),
(2), (4) Date: Mar. 5, 2013

(87) PCT Pub. No.: WO2013/005732

PCT Pub. Date: Jan. 10, 2013

(65) Prior Publication Data

US 2013/0160647 A1 Jun. 27, 2013

(30) Foreign Application Priority Data

Jul. 4, 2011 (JP) ..... 2011-148376

(51) Int. Cl.
*B01D 45/00* (2006.01)
*C23C 2/00* (2006.01)
(Continued)

(52) U.S. Cl.
CPC ..... *C23C 2/003* (2013.01); *B01D 45/06* (2013.01); *C23C 2/00* (2013.01); *C23C 2/02* (2013.01)

(58) Field of Classification Search
CPC ..... C23C 2/003; C23C 2/00; C23C 2/02; B01D 45/06
USPC ..... 55/434, 434.2, 434.3; 95/267
See application file for complete search history.

(56) References Cited

U.S. PATENT DOCUMENTS 6,093,452 A 7/2000 Ishii et al.
6,315,829 B1 11/2001 Ishii et al.

FOREIGN PATENT DOCUMENTS

JP 6-272006 A 9/1994
JP 07-157853 A 6/1995
(Continued)

OTHER PUBLICATIONS

International Search Report for PCT/JP2012/066947 mailed on Oct. 9, 2012.
(Continued)

*Primary Examiner* — Dung H Bui
(74) *Attorney, Agent, or Firm* — Birch, Stewart, Kolasch & Birch, LLP

(57) ABSTRACT

A method and device for removing metal fumes inside a snout in a continuous hot-dip plating plant are provided, which are capable of reliably removing metal fumes causing unplating from the snout without heating an outer wall of the snout. Heated inert gas is supplied to an inside of a snout which is formed between a continuous annealing furnace outlet and a hot-dip metal plating bath. Atmospheric temperature of the inside of the snout and temperature of an inner wall of the snout are maintained, gas having a flow rate greater than a gas supply flow rate is exhausted. A gas stream is formed which flows from the continuous annealing furnace to a surface of the hot-dip metal plating bath, which prevents quality defect from occurring caused by metal fumes generated from molten metal surface.

2 Claims, 12 Drawing Sheets

(51) Int. Cl.
*B01D 45/06* (2006.01)
*C23C 2/02* (2006.01)

(56) References Cited

FOREIGN PATENT DOCUMENTS

| | | | |
|---|---|---|---|
| JP | 07-157854 | A | 6/1995 |
| JP | 7-316760 | A | 12/1995 |
| JP | 8-176773 | A | 7/1996 |
| JP | 10-088304 | A | 4/1998 |
| JP | 11-100649 | A | 4/1999 |
| JP | 11-302811 | A | 11/1999 |

OTHER PUBLICATIONS

Written Opinion of the International Searching Authority for PCT/JP2012/066947 mailed on Oct. 9, 2012.
Office Action issued in China Application No. 201280003436.5 dated Sep. 3, 2014 with English language translation thereof.
Office Action issued in Korean Application No. 10-2013-7012460 dated Sep. 11, 2014 and English language translation thereof.
Korean Office Action dated Dec. 4, 2014 issued in corresponding Korea Application No. 10-2013-7012460.

CROSS SECTION ALONG LINE A-A

CROSS SECTION ALONG LINE B-B

METHOD AND DEVICE FOR REMOVING METAL FUMES INSIDE SNOUT IN CONTINUOUS HOT-DIP PLATING PLANT

TECHNICAL FIELD

The present invention relates to a method and a device for removing metal fumes inside a snout which is formed between a continuous annealing furnace outlet and a hot-dip metal plating bath in a continuous hot-dip plating plant.

BACKGROUND ART

In a continuous hot-dip plating plant, in which a steel plate is plated by being continuously immersed in a hot-dip metal plating bath, it is necessary that the steel plate is immersed in the hot-dip metal plating bath while maintaining the steel plate at a temperature suitable for plating and keeping the surface thereof in a non-oxidized state. For this reason, equipment having a rectangular cross section, which is referred to as snout, is formed between a continuous annealing furnace outlet and the hot-dip metal plating bath.

Since a bottom end of the snout reaches a bath surface of the hot-dip metal plating bath, metal vapor of molten metal generated on a molten metal surface is cooled on a surface of a wall of the snout, and is coagulated and deposited. When this drops, due to the self-weight, vibration, or the like, on the steel plate and attaches to the steel plate, or on the bath surface of the hot-dip metal plating bath and then attaches to the steel plate, it may cause quality defect which is referred to as unplating that a part of the steel plate is not plated. Further, the metal vapor of the molten metal is condensed and formed into a particle shape (having a size of 1 μm or less in many cases), and after having been deposited on the surface of the wall of the snout as metal fumes, is dropped on and attached to the steel plate or is directly attached to the steel plate, which causes a similar quality defect. Those metal vapor and metal fumes further gather together and form metal dust (having a size of 1 μm or more in many cases), which causes a more serious quality defect.

Accordingly, as shown in Patent Document 1, there is suggested technology that an electric heater is installed around a snout to heat the snout from an outside. When this method is adopted, the temperature of the inner wall of the snout rises, and hence, the amount of coagulation and deposition of metal fumes is reduced. However, the amount of coagulation and deposition does not become zero, and metal vapor evaporated from the molten metal surface is continuously coagulated and deposited on the inner wall of the snout, which will eventually drop and cause unplating.

Further, since the heating is performed from an outside using the electric heater, the temperature of the outer side of the snout becomes higher than the temperature of the inner side of the snout, and thus, thermal deformation of the snout easily occurs. When the shell of the snout cracks due to such thermal deformation and the air enters, this also causes quality defect.

In addition, Patent Document 2 suggests, as shown in FIG. 1 and FIGS. 2A to 2C, technology in which an exhaust port 2 is provided to each of the both left and right sides of a lower part of a snout 1 to exhaust atmospheric gas containing metal vapor evaporated from a molten metal surface, the metal vapor is condensed and separated using a separator 3, and then only the atmospheric gas is sent back to the inside of the snout through an air inlet port 4 provided to a position on each of the both left and right sides of an upper part. However, in this arrangement, a short path for the atmospheric gas is formed between the air inlet port 4 and the exhaust port 2, as shown in FIG. 2A. Accordingly, it is not possible to maintain the stream that can shut off the metal vapor in the central part of the snout 1. Therefore, some of the metal vapor slips through the central part of the snout to the upper part as shown by an arrow 5, and remains inside the snout 1. Further, some of the metal vapor that has slipped through to the upper part moves toward the continuous annealing furnace, and coagulates and deposits on the inner wall thereof, which causes unplating in the same manner.

PRIOR ART DOCUMENT

Patent Document

[Patent Document 1] JP 2897668B
[Patent Document 2] JP H7-316760A

DISCLOSURE OF THE INVENTION

Problems to Be Solved by the Invention

An object of the present invention is to solve the above problems, and to provide a method and a device for removing metal fumes inside a snout, which are capable of reliably removing metal fumes causing unplating from the snout without heating the outer wall of the snout. Note that, in the description below, metal fumes (in a broad sense) is used as a term meaning any one of, a combination of two or more of, or a combination of all of the above-mentioned metal vapor, metal fumes (in a narrow sense), and metal dust.

Means for Solving the Problems

In order to solve the above object, according to one aspect of the present invention, there is provided a method for removing metal fumes inside a snout in a continuous hot-dip plating plant, including supplying heated inert gas to an inside of a snout which is formed between a continuous annealing furnace outlet and a hot-dip metal plating bath, and exhausting gas having a flow rate greater than a flow rate of the supplied gas while maintaining an atmospheric temperature of the inside of the snout and a temperature of an inner wall of the snout at a temperature that does not cause coagulation of metal fumes.

In the method for removing metal fumes inside a snout in a continuous hot-dip plating, a steel plate may be passed through inside the snout. It is preferred that a stream of the heated inert gas be formed, the stream flowing from an air inlet port formed on one side surface of the snout to an exhaust port formed on another side surface that is a surface opposite to the one side surface on which the air inlet port is formed and that is at a downstream of the air inlet port in a steel plate passing direction. Further, the air inlet port may be a front side air inlet port capable of supplying air to a front side of the steel plate through a first side surface of the snout, and there may further be provided a back side air inlet port capable of supplying air to a back side of the steel plate through a second side surface of the snout. The exhaust port may be a front side exhaust port capable of exhausting air from the front side of the steel plate through the second side surface, and there may further be provided a back side exhaust port capable of exhausting air from the back side of the steel plate through the first side surface. The heated inert gas may be supplied from the front side air inlet port and exhausted from the front side exhaust port and the heated inert gas may also be supplied from the back side air inlet port and exhausted from the back side exhaust port. Therefore, a gas stream of the heated inert gas is separated into a first gas stream flowing along the front side of the steel plate and a second gas stream flowing along the back side of the steel plate. The first gas stream and the second gas stream also cross each other in a separated manner at front and back of the steel plate.

Further, according to another aspect of the present invention, there is provided a device for removing metal fumes inside a snout in a continuous hot-dip plating plant, including a unit configured to supply heated inert gas to an inside of a snout which is formed between a continuous annealing furnace outlet and a hot-dip metal plating bath, and a unit configured to exhaust gas having a flow rate greater than a flow rate of the supplied gas while maintaining an atmospheric temperature of the inside of the snout and a temperature of an inner wall of the snout at a temperature that does not cause coagulation of metal fumes.

In the device for removing metal fumes, a steel plate may be passed through inside the snout. It is preferred that the device include an air inlet port formed on one side surface of the snout and an exhaust port formed on another side surface that is a surface opposite to the one side surface on which the air inlet port is formed and that is at a downstream of the air inlet port in a steel plate passing direction, and that a stream of the heated inert gas be formed which flows from the air inlet port to the exhaust port. Further, the air inlet port may be a front side air inlet port capable of supplying air to a front side of the steel plate through a first side surface of the snout, and there may further be provided a back side air inlet port capable of supplying air to a back side of the steel plate through a second side surface of the snout. The exhaust port may be a front side exhaust port capable of exhausting air from the front side of the steel plate through the second side surface, and there may further be provided a back side exhaust port capable of exhausting air from the back side of the steel plate through the first side surface. The heated inert gas may be supplied from the front side air inlet port and exhausted from the front side exhaust port and the heated inert gas may also be supplied from the back side air inlet port and exhausted from the back side exhaust port. Therefore, a gas stream of the heated inert gas is separated into a first gas stream flowing along the front side of the steel plate and a second gas stream flowing along the back side of the steel plate. The first gas stream and the second gas stream also cross each other in a separated manner at front and back of the steel plate.

Effect of the Invention

According to the present invention, the heated inert gas is supplied to the inside of the snout to maintain the atmospheric temperature of the inside of the snout and the temperature of the inner wall of the snout at a temperature that does not cause the coagulation of the metal fumes, the exhausted gas having a flow rate greater than the flow rate of the supplied gas. Accordingly, since the metal fumes evaporated from the molten metal surface join the gas stream and are exhausted from the inside of the snout, the coagulation and deposition do not occur on the surface of a wall of the snout. In addition, the pressure of the inside of the snout is kept negative, and hence, a stream is formed which flows from the continuous annealing furnace outlet to the exhaust port of the snout, and the metal fumes do not enter the continuous annealing furnace. As the result thereof, the rate of occurrence of unplating can be significantly reduced. Further, there is no risk of thermally deforming the snout as in the case of heating the outer side of the snout of the prior art.

Further, when air inlet ports and exhaust ports corresponding thereto, respectively, are disposed separately in the front and back side of a steel plate that is passed through inside the snout, the inert gas streams flowing from the air inlet ports to the exhaust ports are caused to cross each other in a separated manner at the front and the back side of the steel plate. Accordingly, collision of the gas streams and passing of the gas streams along short paths can be prevented. Therefore, it can be reliably prevented that the metal fumes evaporated from the molten metal surface slip through to the upper part, and a more desirable result can be obtained.

MODE FOR CARRYING OUT THE INVENTION

Figure 1:
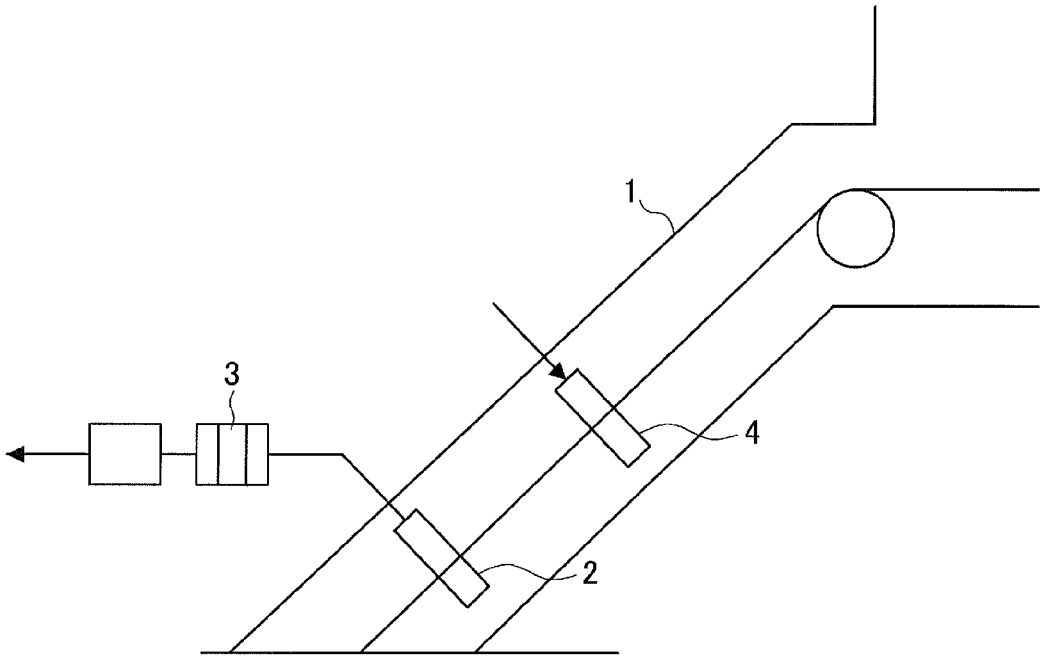
FIG. 1 is a side cross-sectional view showing a snout according to prior art.
Figure 2A:
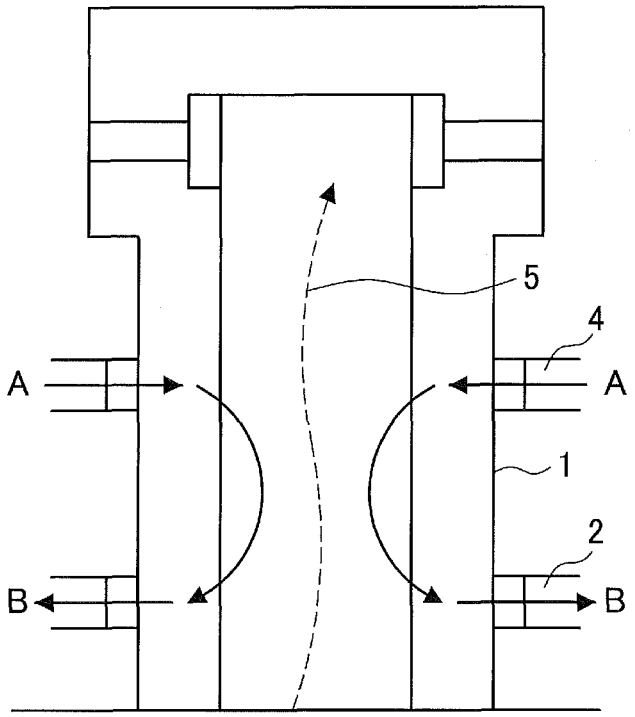
FIG. 2A is an elevational view showing the snout according to prior art.
Figure 2B:
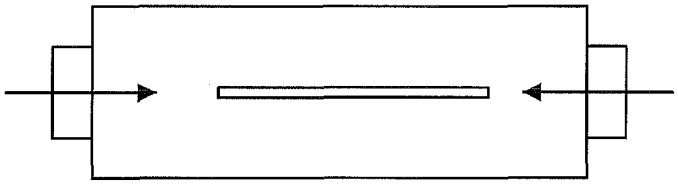
FIG. 2B is a cross-sectional view along the line A-A of FIG. 2A.
Figure 2C:
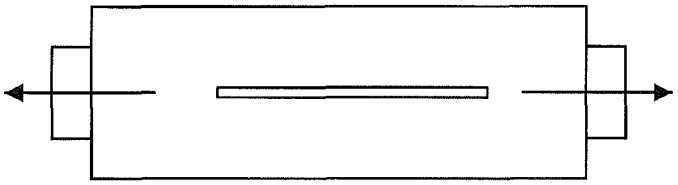
FIG. 2C is a cross-sectional view along the line B-B of FIG. 2A.
Figure 3:
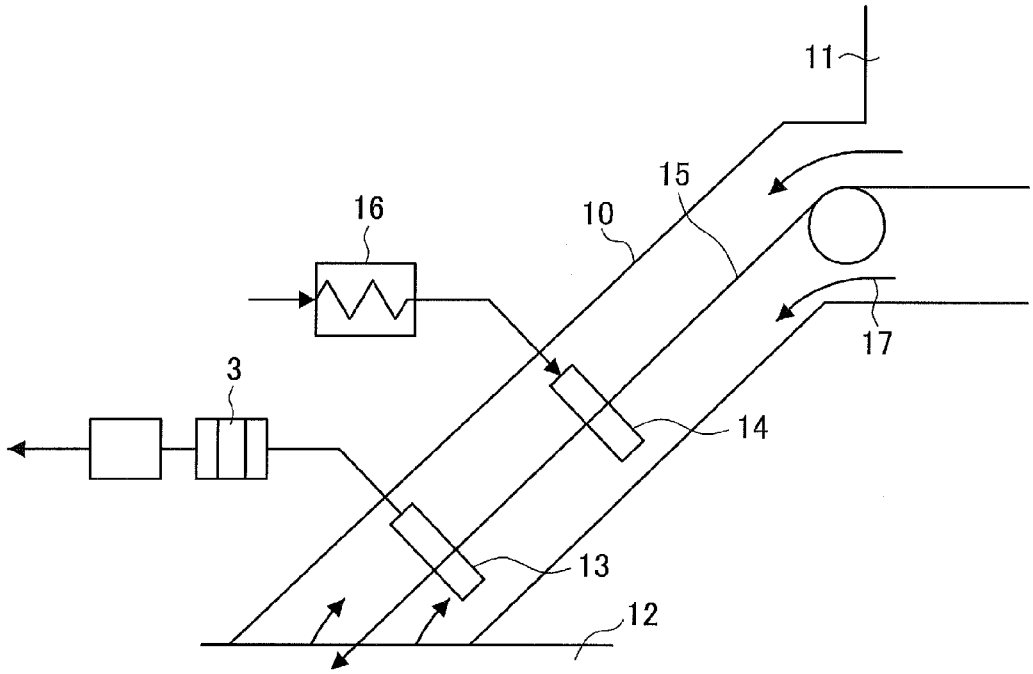
FIG. 3 is a side cross-sectional view showing a snout according to an embodiment of the present invention.

Hereinafter, referring to the appended drawings, preferred embodiments of the present invention will be described in detail. It should be noted that, in this specification and the appended drawings, structural elements that have substantially the same function and structure are denoted with the same reference numerals, and repeated explanation thereof is omitted.

FIG. 3 and FIGS. 4A to 4C are each a diagram showing an embodiment of the present invention. A snout 10 is formed between a continuous annealing furnace outlet 11 and a hot-dip metal plating bath 12. In general, although in most of the cases the snout 10 has a rectangular cross section, the shape of the cross section is not necessarily limited to a rectangle, and may be any shape as long as it is approximately a rectangle. The exhaust port 13 is formed at a lower side of the snout 10, which is near to the hot-dip metal plating bath 12, on each of the both side surfaces of the snout 10. The air inlet port 14 is formed at a position higher than the exhaust port 13, that is, at an upper side of the snout 10, which is near to the continuous annealing furnace, on each of the both side surfaces of the snout 10. Inside the snout 10, a steel plate 15 that has come out from the continuous annealing furnace runs continuously toward the hot-dip metal plating bath 12. In the hot-dip metal plating bath 12, the steel plate 15 is subjected to hot-dip galvanizing, for example.

Figure 4A:
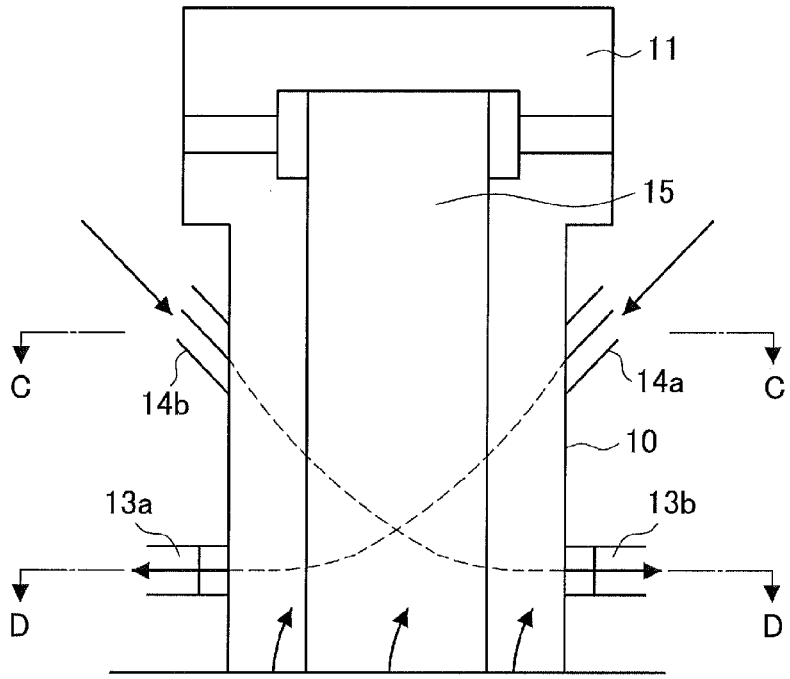
FIG. 4A is an elevational view showing the snout according to an embodiment of the present invention.

As shown in FIG. 4A, in the present embodiment, air inlet ports 14*a* and 14*b* formed on side surfaces of the snout 10 are formed obliquely downward toward exhaust ports 13*a* and 13*b* formed on the respective opposite side surfaces of the snout 10. From those air inlet ports 14*a* and 14*b*, inert gas heated by a heater 16 is blown inside the snout 10. That is, the heated inert gas is blown in an oblique direction with respect to the extending direction of the snout 10 (direction from the continuous annealing furnace to the hot-dip metal plating bath 12). As the inert gas, nitrogen gas is used, for example. With the heated inert gas being blown in in this manner, the atmospheric temperature of the inside of the snout 10 and the temperature of the inner wall of the snout are maintained at high temperature and approximately uniform, and thus, coagulation and deposition of the metal fumes on the inner wall of the snout 10 are suppressed. Further, thermal deformation of the snout 10 can also be prevented.

Figure 4B:
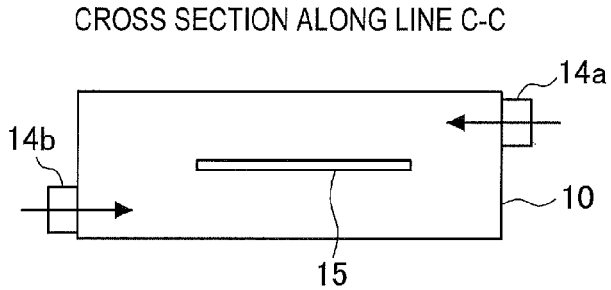
FIG. 4B is a cross-sectional view along the line C-C of FIG. 4A.
Figure 4C:
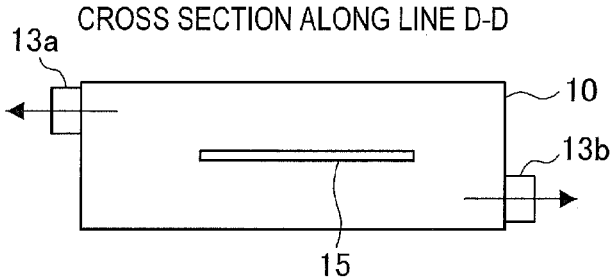
FIG. 4C is a cross-sectional view along the line D-D of FIG. 4A.
Figure 6A:
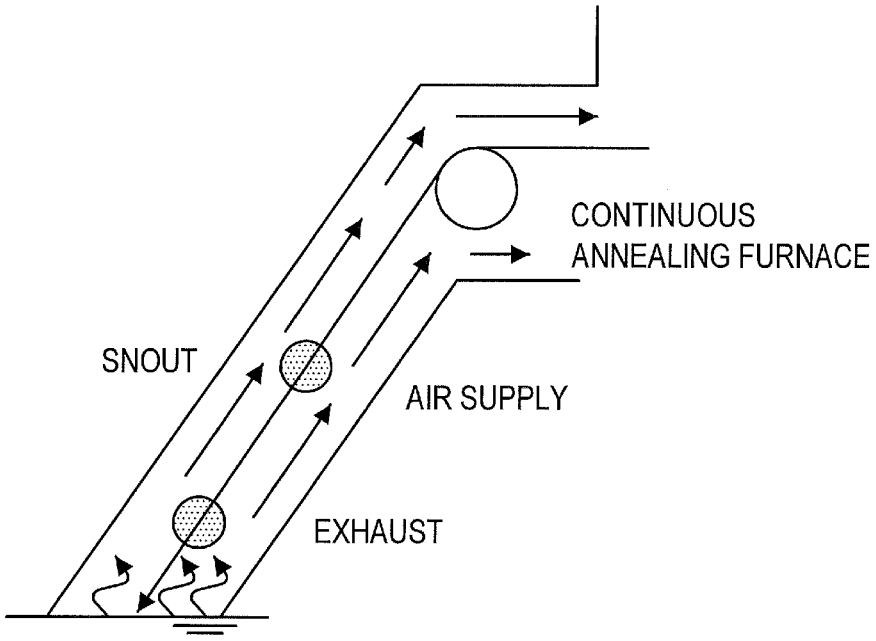
FIG. 6A is a diagram schematically showing an air stream inside the snout under a state in which the exhaust rate is less than 100%.
Figure 6B:
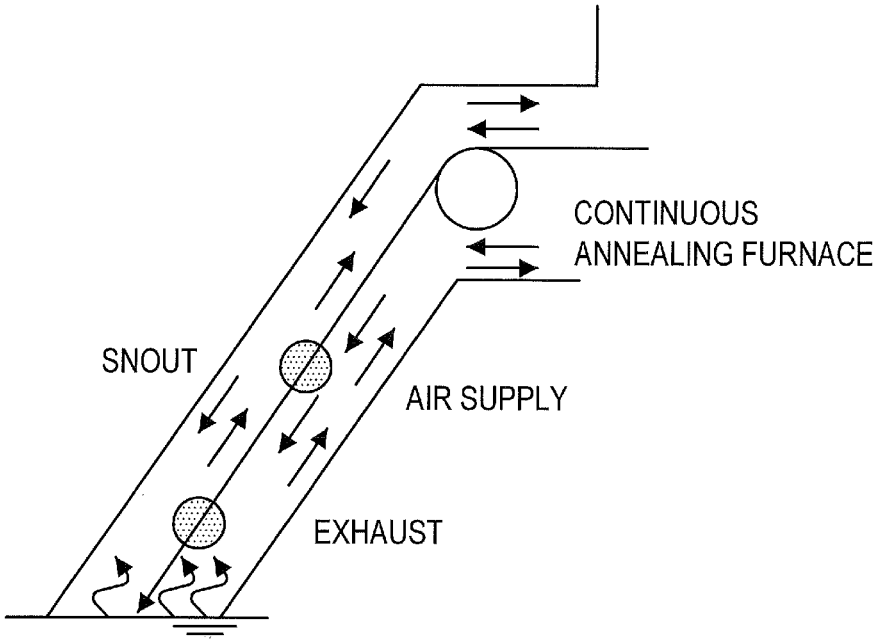
FIG. 6B is a diagram schematically showing an air stream inside the snout under a state in which the exhaust rate is 100%.
Figure 6C:
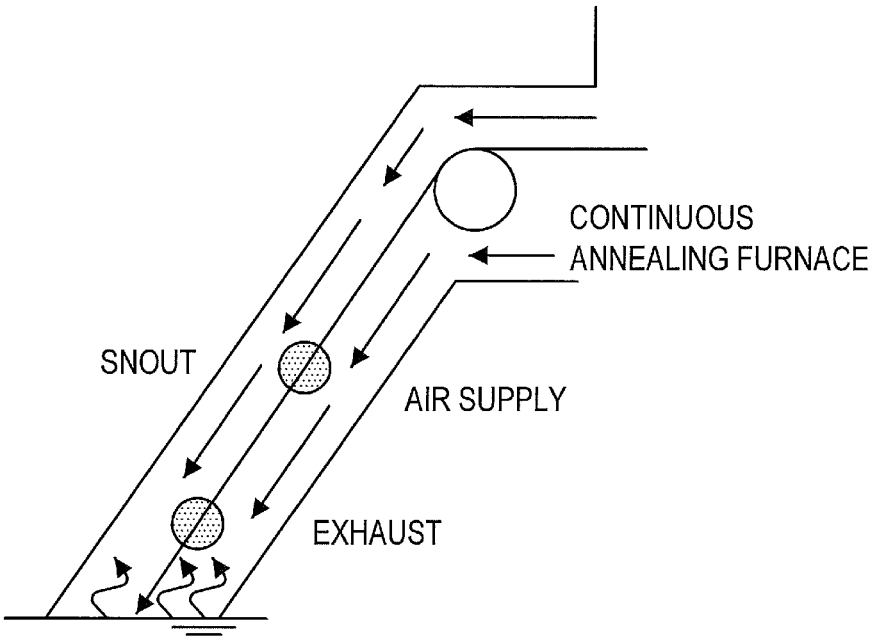
FIG. 6C is a diagram schematically showing an air stream inside the snout under a state in which the exhaust rate exceeds 100%.

As shown in FIG. 4A, the inert gas blown in from the air inlet port 14*a* and the inert gas blown in from the air inlet port 14*b*, the air inlet ports 14*a* and 14*b* being provided at right and left side surfaces, cross each other in a separated manner in the inside of the snout 10, and are exhausted from the exhaust ports 13*a* and 13*b*. In more detail, from the air inlet port 14*a* formed on the right side surface of the snout 10, the inert gas is blown in toward the exhaust port 13*a* formed on the left side surface. From the air inlet port 14*b* formed on the left side surface of the snout 10, the inert gas is blown in toward the exhaust port 13*b* formed on the right side surface. In order to cause gas streams of the blown-in inert gas to cross each other in a separated manner in the inside of the snout 10, the air inlet ports 14*a* and 14*b*, and the exhaust ports 13*a* and 13*b* are disposed separately at the front and back of a steel plate 15 that is passed through inside the snout 10. That is, as shown in FIG. 4B and FIG. 4C which are the cross-sectional view along the line C-C of FIG. 4A and the cross-sectional view along the line D-D of FIG. 4A, respectively, the air inlet port 14*a* is disposed at the front side of the steel plate 15, and the air inlet port 14*b* is disposed at the back side of the steel plate 15. On the other hand, the exhaust port 13*a* is disposed at the front side of the steel plate 15, and the exhaust port 13*b* is disposed at the back side of the steel plate 15. In this way, the gas stream from the air inlet port 14*a* to the exhaust port 13*a* at the front side of the steel plate 15 and the gas stream from the air inlet port 14*b* to the exhaust port 13*b* at the back side of the steel plate 15 cross each other in a separated manner with the steel plate 15 being provided therebetween. With the generation of such gas stream in the inside of the snout 10, it can be prevented that the metal fumes rising from the side of the hot-dip metal plating bath 12 slip through the gas stream and flow to the side of the continuous annealing furnace. Note that, although it is preferred that the air inlet ports 14*a* and 14*b* and the exhaust ports 13*a* and 13*b* be provided completely separately on the front side and on the back side of the steel plate 15 as shown in FIGS. 4A to C, it is also allowed to have one air inlet port or one exhaust port that occupies over the front and back of the steel plate 15 as shown in FIGS. 6A to C to be described later, since the presence of the steel plate 15 itself separates the gas stream.

In addition, in the present invention, the gas exhausted from the exhaust port 13 has a flow rate greater than the supplied gas. Accordingly, the pressure of the inside of the snout 10 becomes slightly negative, and, as shown by an arrow 17 in FIG. 3, a gas stream is formed from the continuous annealing furnace to the snout 10. Therefore, metal fumes generated from the hot-dip metal plating bath 12 are reliably exhausted from the exhaust port 13. Further, it can be also prevented that the metal fumes enter inside the continuous annealing furnace.

In this way, according to the present invention, since the metal fumes inside the snout can be removed rapidly, generation of unplating can be significantly reduced. Hereinafter, specific data thereof will be described.

Figure 5:
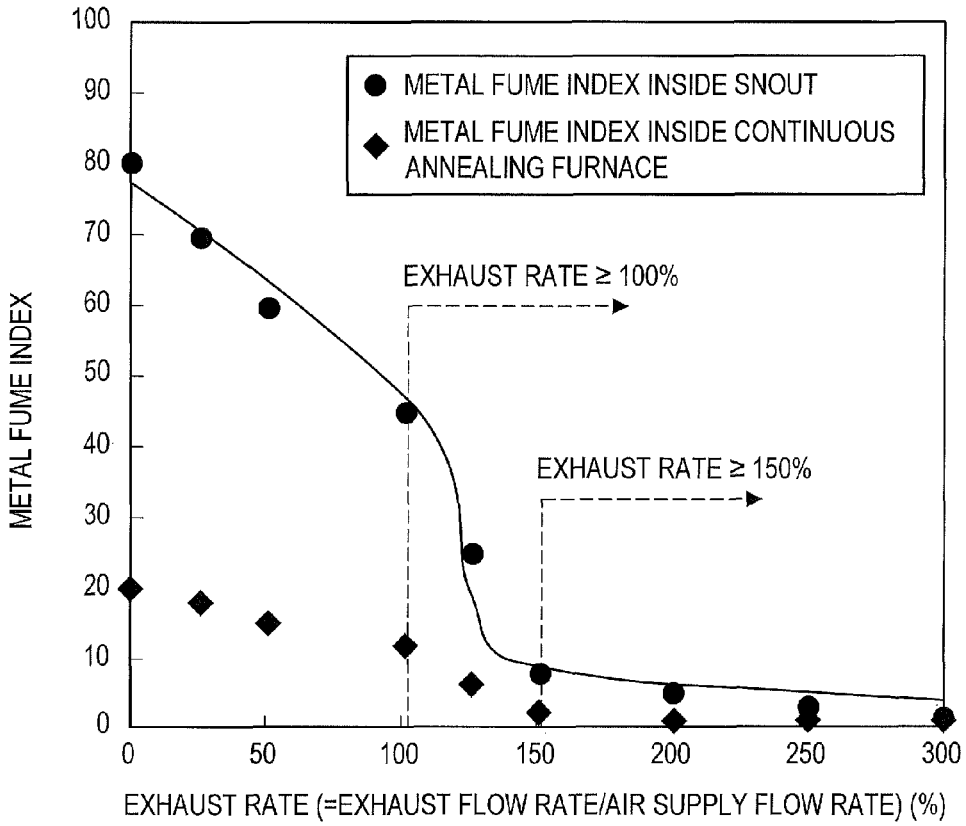
FIG. 5 is a graph showing a relationship between an exhaust rate and a metal fume index.

FIG. 5 is a graph showing a relationship between an exhaust rate and an amount of metal fumes inside the snout or an amount of metal fumes inside the continuous annealing furnace. Here, the exhaust rate on the horizontal axis is determined by dividing the exhaust flow rate by the air supply flow rate and is represented in percentage. The metal fume index inside the snout or inside the continuous annealing furnace on the vertical axis is a value determined by representing in an index a mass of metal fumes (in a broad sense) present inside the snout or inside the continuous annealing furnace, where the total value of the mass of metal fumes inside the snout and the mass of metal fumes inside the continuous annealing furnace is 100 when the exhaust rate is zero.

With reference to the graph, the metal fume index inside the snout represented by a black dot drastically decreases when the exhaust rate exceeds 100%. However, when the exhaust rate becomes 150% or more, the rate of decline of metal fume index per exhaust rate becomes low, and even if the exhaust rate is increased further, the metal fume index does not change much. From this result, it is found that in order to obtain a notable effect in reduction of metal fumes inside the snout, it is preferred to set the exhaust rate to a value exceeding 100%. Further, it is also found that it is sufficient when the exhaust rate is set to 150% or more. Meanwhile, in the same manner, the metal fume index inside the continuous annealing furnace represented by a rhombus drastically decreases when the exhaust rate exceeds 100%, and does not change much when the exhaust rate becomes 150% or more. Accordingly, it may also be said that in order to obtain a notable effect in reduction of metal fumes inside the continuous annealing furnace, it is preferred to set the exhaust rate to a value exceeding 100%, and it is sufficient when the exhaust rate is set to 150% or more.

FIGS. 6A to 6C are each a diagram schematically showing an air stream inside the snout based on difference in the exhaust rate, and FIG. 6A represents a state in which the exhaust rate is less than 100%, FIG. 6B represents a state in which the exhaust rate is 100%, and FIG. 6C represents a state in which the exhaust rate exceeds 100%. Under the sate shown in FIG. 6A, since the gas stream is formed from the snout to the continuous annealing furnace, fumes coagulates and deposits on the entire inner wall of the snout and the entire furnace wall of the continuous annealing furnace, which causes quality defect. On the contrary, under the state shown in FIG. 6C, since the gas stream is formed from the continuous annealing furnace to a molten metal surface, coagulation and deposition of the metal fumes on the inner wall of the snout and the furnace wall of the continuous annealing furnace are suppressed. FIG. 6B shows the state in which the both streams are balanced, but since there is also a gas stream that flows toward the continuous annealing furnace, it is unable to obtain sufficient metal fume-suppression effect.

Figure 7A:
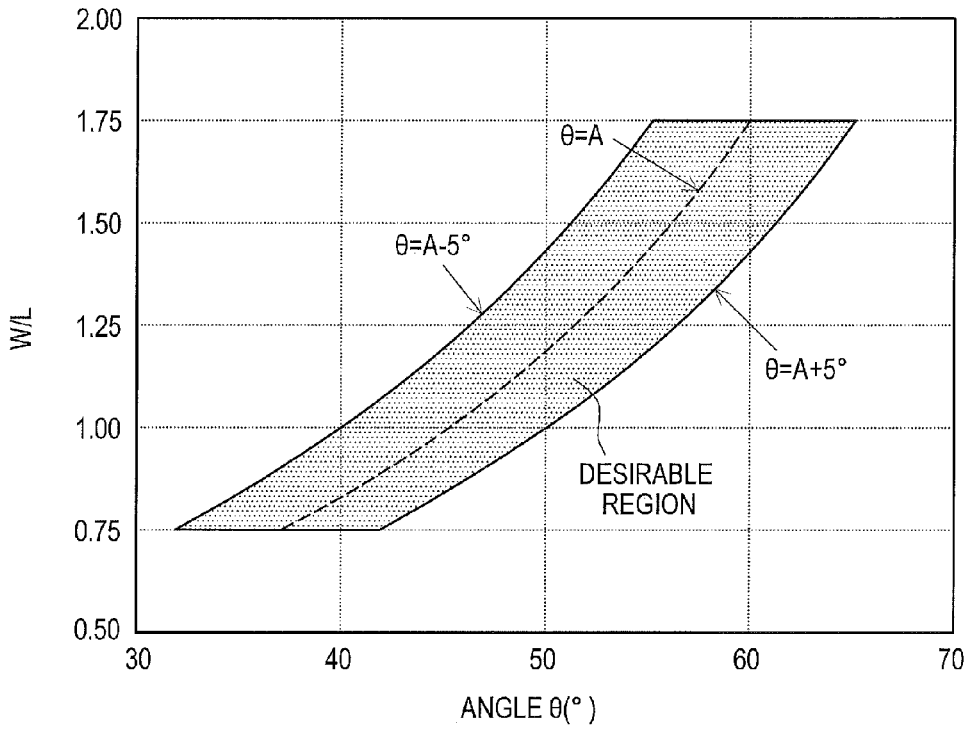
FIG. 7A is a graph showing a result obtained by studying a desirable positional relationship between an air inlet port and an exhaust port.
Figure 7B:
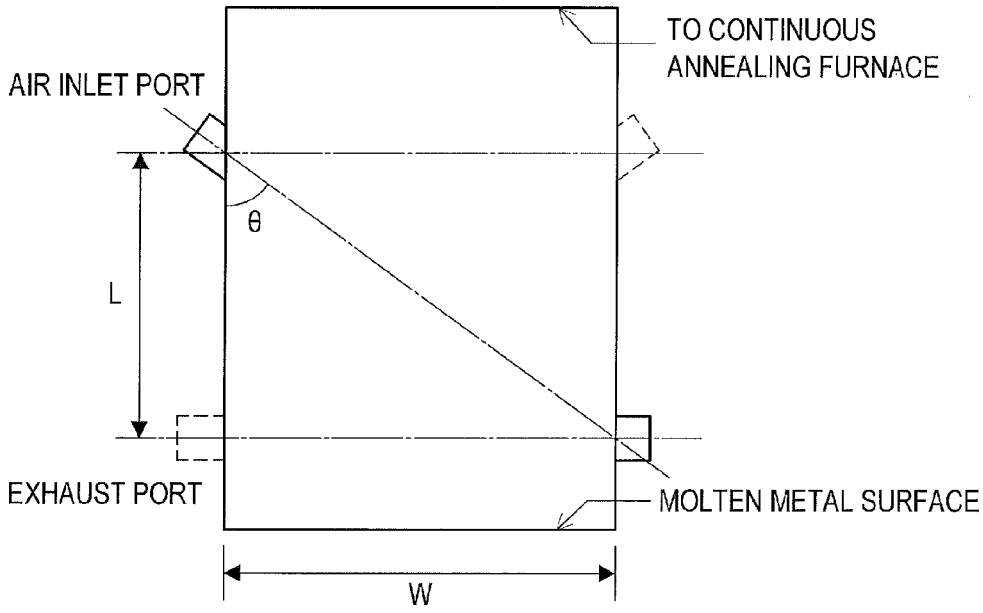
FIG. 7B is a diagram illustrating the result shown in FIG. 7A.

FIG. 7A, FIG. 7B, and FIGS. 8A to 8D are each a diagram showing a result obtained by studying a positional relationship between an air inlet port and an exhaust port. In this study, as shown in FIG. 7B, the width of the snout is represented by W, the difference between the heights of the air inlet port and the exhaust port is represented by L, and in addition, the angle between the line connecting the air inlet port and the exhaust port and the extending direction of the snout is represented by θ. Note that, in the present embodiment, since the air inlet port is provided in a manner that it faces the direction of the exhaust port, the angle of the air inlet port with respect to the side surface of the snout is equal to the angle θ.

The results of the study are shown in the graph of FIG. 7A. A desired positional relationship between the air inlet port and the exhaust port is defined with W/L and the angle θ. To be more specific, a region satisfying the following is desirable, $0.75 \leq W/L \leq 1.75$ and $A-5° \leq \theta \leq A+5°$. Here, the angle A is an angle defined as $A=\arctan(W/L)$ (that is, $\tan A=W/L$). Note that, W is usually 2 to 3 meters in an actual machine, and in this case, it is preferred that L be 4 to 5 meters.

Figure 8A:
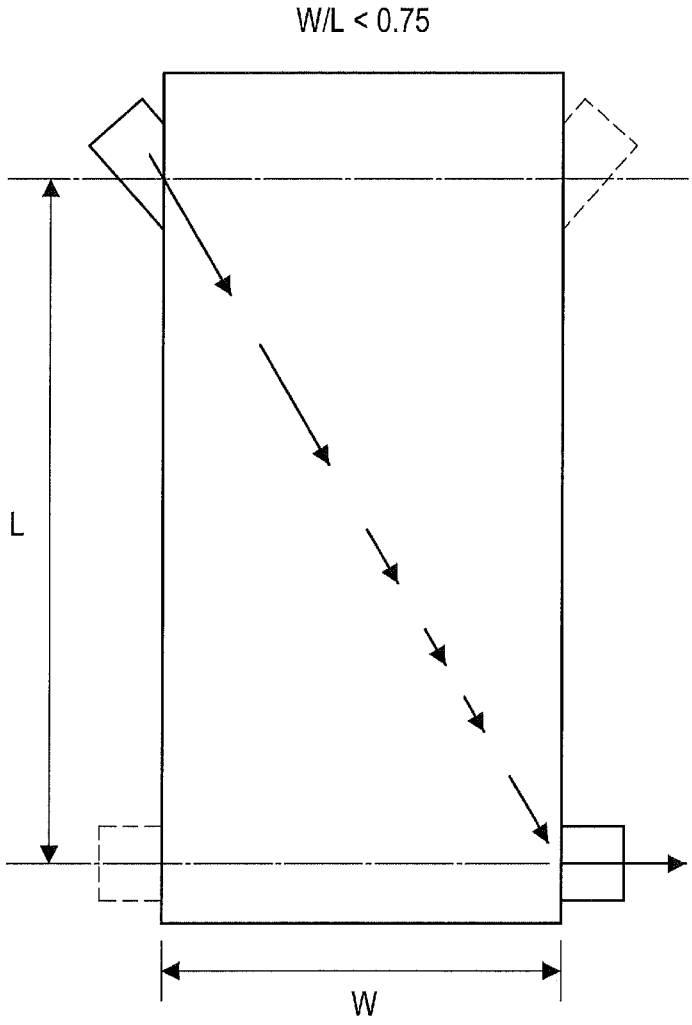
FIG. 8A is a diagram explaining a specific reason that the positional relationship shown in FIG. 7A is desirable, and shows a case where W/L is less than 0.75.
Figure 8B:
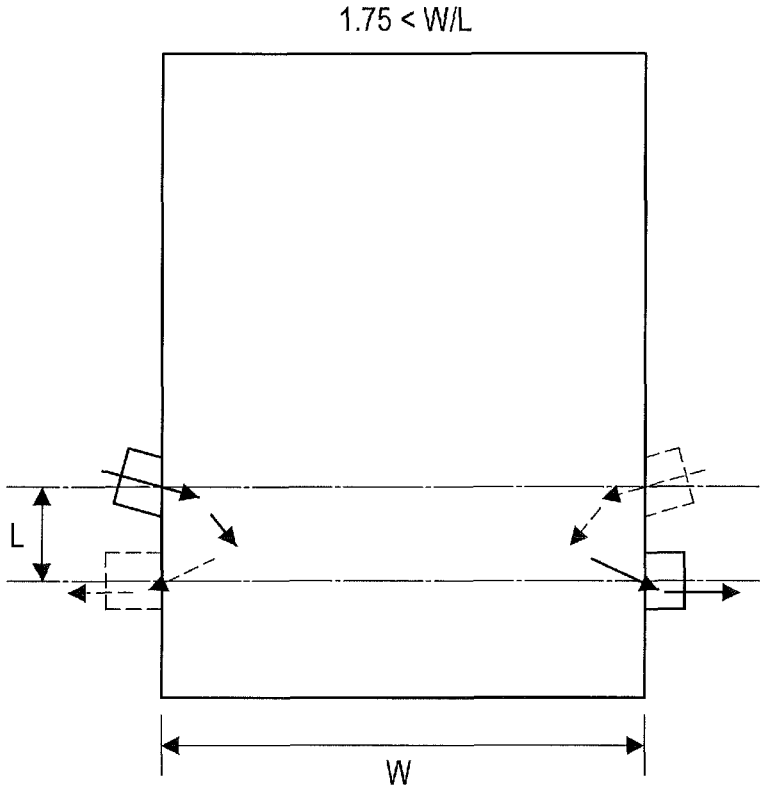
FIG. 8B is a diagram explaining a specific reason that the positional relationship shown in FIG. 7A is desirable, and shows a case where W/L exceeds 1.75.

FIGS. 8A to 8D are each a diagram illustrating a specific reason for the above study. As shown in FIG. 8A, when W/L is less than 0.75, the distance between the air inlet port and the exhaust port is too long and a gas stream emitted from the air inlet port attenuates before reaching the exhaust port, and hence, some of the gas passes along a short path. Accordingly, the gas stream is weakened, and some of the metal fumes generated from the bath surface traverse the gas stream and slip through to the side of the continuous annealing furnace. On the contrary, as shown in FIG. 8B, when W/L exceeds 1.75, the gas stream emitted from the air inlet port passes along a short path to the exhaust port which is disposed at the back surface side of the air inlet port, and the similar problem occurs.

Figure 8C:
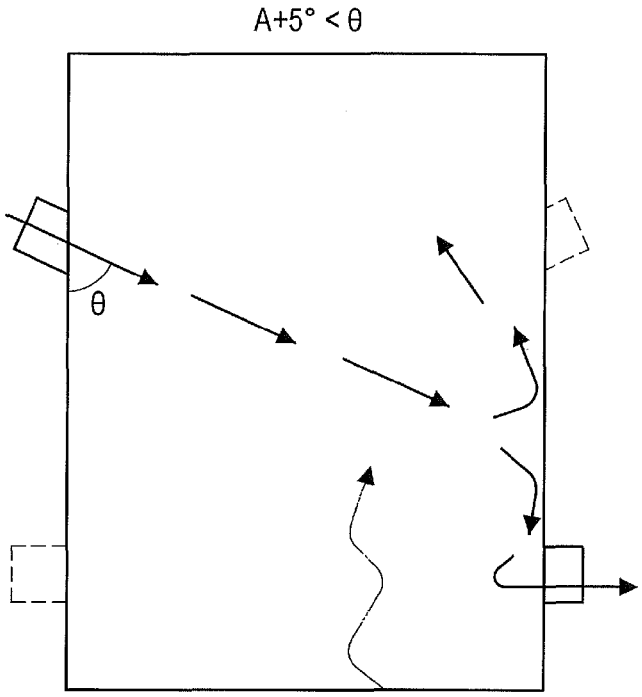
FIG. 8C is a diagram explaining a specific reason that the positional relationship shown in FIG. 7A is desirable, and shows a case where $\theta$ exceeds A+5°.
Figure 8D:
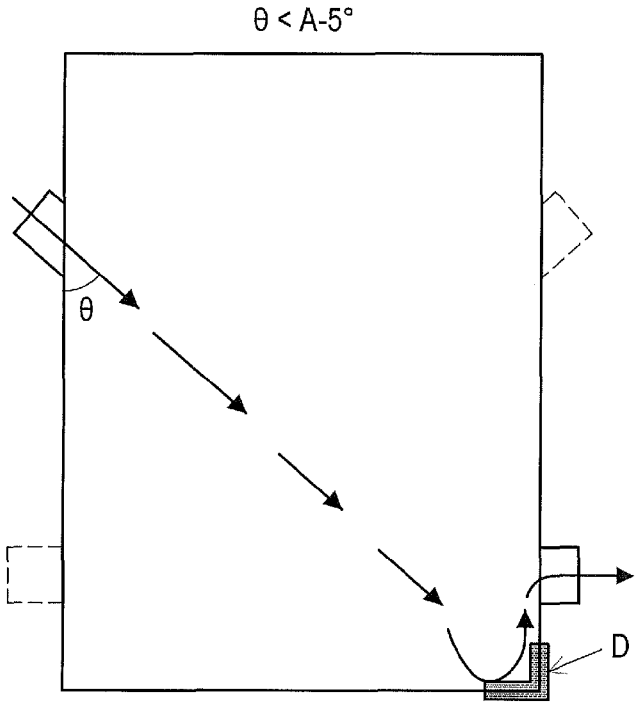
FIG. 8D is a diagram explaining a specific reason that the positional relationship shown in FIG. 7A is desirable, and shows a case where $\theta$ is less than A−5°.

Further, as shown in FIG. 8C, when θ exceeds A+5°, the gas emitted from the air inlet port collides with an upper side of the exhaust port and is separated into a stream that flows toward the continuous annealing furnace and a stream that flows toward the exhaust port. Accordingly, in the case where the fumes generated from the bath surface join the gas stream before the separation, the fumes may leak to the continuous annealing furnace. On the contrary, as shown in FIG. 8D, when θ is less than A−5°, the gas emitted from the air inlet port collides with a lower side of the exhaust port. Accordingly, due to the fluctuation of the bath surface, a small mass of a top dross D, which is an alloy of iron and aluminum and is attached to a lower part of the inner wall of the snout, is detached, is dropped on the molten metal surface, is drawn to the accompanying stream of the steel plate, and attaches to the steel plate, which may cause quality defect.

An embodiment of the present invention described above is applied to a plant for manufacturing a hot-dip galvanized steel plate, and an unplating occurrence index could be reduced to 26. Here, the unplating occurrence index is a value determined by representing in an index a ratio of yield reduction caused by unplating, where the case of not applying the above embodiment is set to 100.

Heretofore, preferred embodiments of the present invention have been described in detail with reference to the appended drawings, but the present invention is not limited thereto. It should be understood by those skilled in the art that various changes and alterations may be made without departing from the spirit and scope of the appended claims.

REFERENCE SIGNS LIST

10 snout
11 continuous annealing furnace outlet
12 hot-dip metal plating bath
13 exhaust port
14 air inlet port
15 steel plate
16 heater
17 arrow indicating gas stream flowing from continuous annealing furnace to snout

The invention claimed is:

1. A method for removing metal fumes inside a snout in a continuous hot-dip plating plant, comprising:

supplying heated inert gas as a supplied gas to an inside of a snout which is formed between a continuous annealing furnace outlet and a hot-dip metal plating bath; and exhausting gas having a flow rate greater than a flow rate of the supplied gas while maintaining an atmospheric temperature that does not cause coagulation of metal fumes;

wherein a steel plate is passed through inside the snout, and wherein a stream of the heated inert gas is formed, the stream flowing from an air inlet port formed on one side surface of the snout to an exhaust port formed on another side surface that is a surface opposite to the one side surface on which the air inlet port is formed and that is at a downstream of the air inlet port in a steel plate passing direction; and wherein the air inlet port is a front side air inlet port capable of supplying air to a front side of the steel plate through a first side surface of the snout, and there is further provided a back side air inlet port capable of supplying air to a back side of the steel plate through a second side surface of the snout, wherein the exhaust port is a front side exhaust port capable of exhausting air from the front side of the steel plate through the second side surface, and there is further provided a back side exhaust port capable of exhausting air from the back side of the steel plate through the first side surface, and wherein the heated inert gas is supplied from the front side air inlet port and exhausted from the front side exhaust port and the heated inert gas is also supplied from the back side air inlet port and exhausted from the back side exhaust port, and thereby separating a gas stream of the heated inert gas into a first gas stream flowing along the front side of the steel plate and a second gas stream flowing along the back side of the steel plate and causing the first gas stream and the second gas stream to cross each other in a separated manner at front and back of the steel plate.

2. A device for removing metal fumes inside a snout in a continuous hot-dip plating plant, comprising:

a unit configured to supply heated inert gas as a supplied gas to an inside of a snout which is formed between a continuous annealing furnace outlet and a hot-dip metal plating bath, and a unit configured to exhaust gas having a flow rate greater than a flow rate of the supplied gas while maintaining an atmospheric temperature of the inside of the snout and a temperature of an inner wall of the snout at a temperature that does not cause coagulation of metal fumes;

wherein a steel plate is passed through inside the snout, wherein the device includes an air inlet port formed on one side surface of the snout and an exhaust port formed on another side surface that is a surface opposite to the one side surface on which the air inlet port is formed and that is at a downstream of the air inlet port in a steel plate passing direction, wherein a stream of the heated inert gas is formed which flows from the air inlet port to the exhaust port;

wherein the air inlet port is a front side air inlet port capable of supplying air to a front side of the steel plate through a first side surface of the snout, and there is further provided a back side air inlet port capable of supplying air to a back side of the steel plate through a second side surface of the snout, wherein the exhaust port is a front side exhaust port capable of exhausting air from the front side of the steel plate through the second side surface, and there is further provided a back side exhaust port capable of exhausting air from the back side of the steel plate through the first side surface, and wherein the heated inert gas is supplied from the front side air inlet port and exhausted from the front side exhaust port and the heated inert gas is also supplied from the back side air inlet port and exhausted from the back side exhaust port, and thereby separating a gas stream of the heated inert gas into a first gas stream flowing along the front side of the steel plate and a second gas stream flowing along the back side of the steel plate and causing the first gas stream and the second gas stream to cross each other in a separated manner at front and back of the steel plate.

* * * * *